US010139068B2

(12) United States Patent
Plank et al.

(10) Patent No.: US 10,139,068 B2
(45) Date of Patent: Nov. 27, 2018

(54) LIGHT SOURCE ARRANGEMENT IN A PIXEL-LIGHT LIGHT MODULE

(71) Applicant: ZKW Group GmbH, Wieselburg (AT)

(72) Inventors: Josef Plank, Purgstall/Erlauf (AT); Lukas Taudt, Wieselburg (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 15/758,037

(22) PCT Filed: Sep. 5, 2016

(86) PCT No.: PCT/AT2016/060050
§ 371 (c)(1),
(2) Date: Mar. 7, 2018

(87) PCT Pub. No.: WO2017/045000
PCT Pub. Date: Mar. 23, 2017

(65) Prior Publication Data

US 2018/0245759 A1 Aug. 30, 2018

(30) Foreign Application Priority Data

Sep. 17, 2015 (AT) ..... A 50798/2015

(51) Int. Cl.
*F21S 41/24* (2018.01)
*F21S 41/65* (2018.01)
(Continued)

(52) U.S. Cl.
CPC ..... *F21S 41/24* (2018.01); *F21S 41/143* (2018.01); *F21S 41/255* (2018.01); *F21S 41/65* (2018.01);
(Continued)

(58) Field of Classification Search
CPC ..... F21S 41/24; F21S 41/143; F21S 41/255; F21S 41/265; F21S 41/285; F21S 41/65;
(Continued)

(56) References Cited

U.S. PATENT DOCUMENTS 8,721,146 B2 5/2014 Kathmann et al.
8,801,242 B2 * 8/2014 Hamm ..... B60Q 1/1423 362/487
(Continued)

FOREIGN PATENT DOCUMENTS

DE 102008044968 A1 7/2009
DE 102009020619 A1 11/2010
EP 2306075 A2 4/2011

OTHER PUBLICATIONS

Austrian Search Report issued in Application No. A 50798/2015, dated Jul. 19, 2016 (3 pages).
(Continued)

*Primary Examiner* — Mariceli Santiago
(74) *Attorney, Agent, or Firm* — Eversheds Sutherland (US) LLP

(57) ABSTRACT

The invention relates to a lighting device (20, 30) for a headlight, in particular a motor-vehicle headlight, comprising a plurality of light sources (200, 300), which are arranged adjacent to each other in rows (201, 202, 203, 301, 302, 303) and which form a lighting field (209, 309), and comprising a light-guiding device (204, 304) having a plurality of light-guiding elements (201*a*, 202*a*, 203*a*, 301*a*, 302*a*, 303*a*), wherein each light-guiding element (201*a*, 202*a*, 203*a*, 301*a*, 302*a*, 303*a*) is associated with one light source (200, 300), wherein each light-guiding element (201*a*, 202*a*, 203*a*, 301*a*, 302*a*, 303*a*) has a light incoupling surface (201*b*, 202*b*, 203*b*, 301*b*, 302*b*, 303*b*) for coupling in light emitted by the particular light source and a light outlet surface, wherein the light-guiding elements (201*a*,
(Continued)

Figure 1:
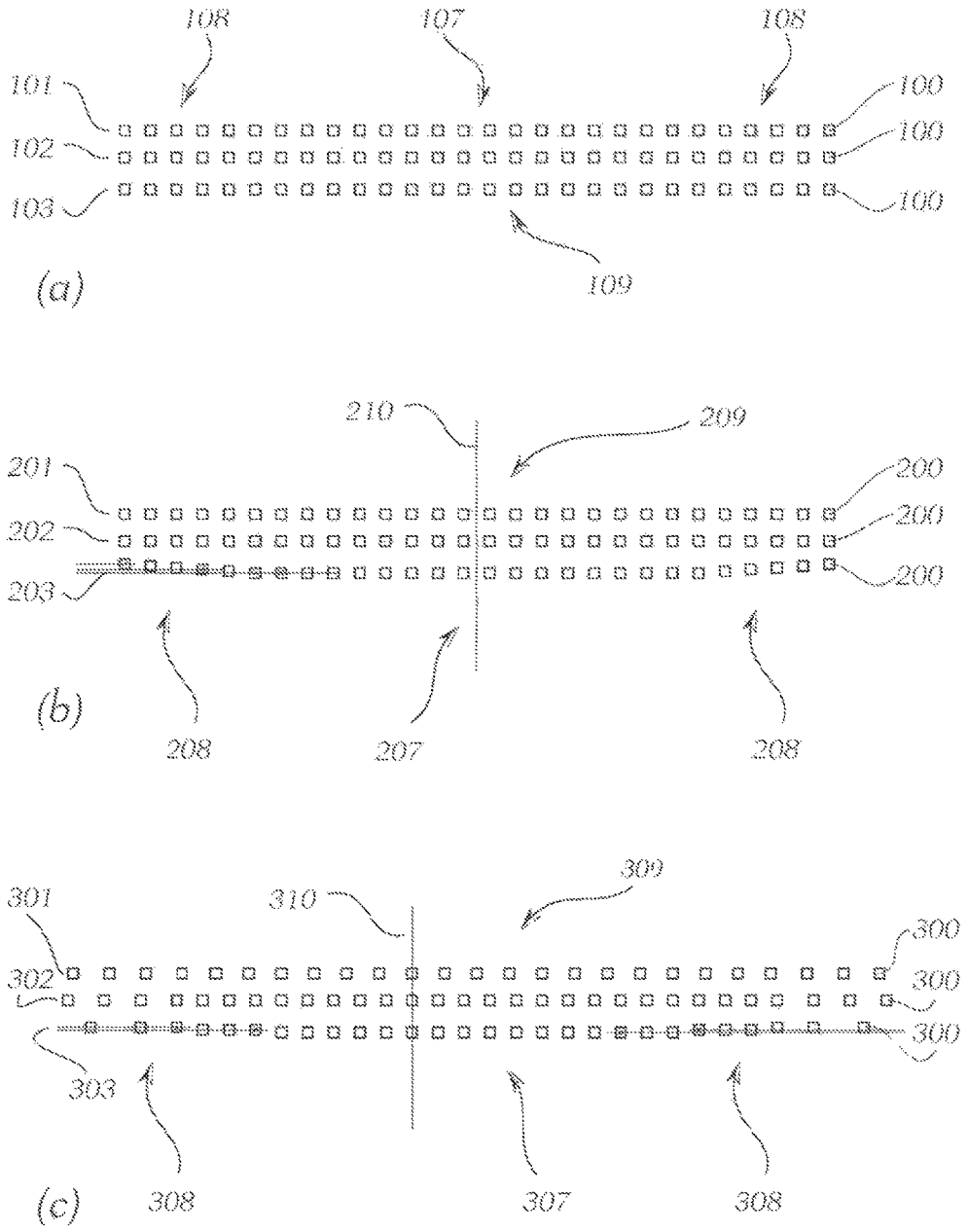

202*a*, 203*a*, 301*a*, 302*a*, 303*a*) are arranged in at least two linear rows (211, 212, 213, 311, 312, 313) arranged one over the other, and wherein the light-guiding elements (203*a*, 303*a*) of the lowest row (213, 313) are designed as high-beam light-guiding elements (201*a*, 301*a*) and form a high-beam row (213, 313), wherein the vertical distance between the light sources (200, 300) of the high-beam row (213, 313) and the light sources (200, 300) of the row (212, 312) arranged adjacent in the upward direction is smaller in at least one lateral edge region (208, 308) of the lighting field (209, 309) than in a central region (207, 307) of the lighting field (209, 309).

17 Claims, 3 Drawing Sheets

(51) Int. Cl.

| | |
|---|---|
| ***F21S 41/143*** | (2018.01) |
| ***F21S 41/255*** | (2018.01) |
| *F21W 102/13* | (2018.01) |
| *F21Y 105/12* | (2016.01) |
| *F21Y 115/10* | (2016.01) |

(52) U.S. Cl.
CPC ..... *F21W 2102/13* (2018.01); *F21Y 2105/12* (2016.08); *F21Y 2115/10* (2016.08)

(58) Field of Classification Search
CPC ..... F21Y 2105/12; F21Y 2115/10; F21W 2102/13
See application file for complete search history.

(56) References Cited

U.S. PATENT DOCUMENTS

| | | | | |
|---|---|---|---|---|
| 9,046,237 | B2 | 6/2015 | Stefanov et al. | |
| 9,651,213 | B2 | 5/2017 | Kliebisch | |
| 9,879,835 | B2 | 1/2018 | Taudt et al. | |
| 2008/0062712 | A1 | 3/2008 | Woodward | |
| 2009/0016074 | A1 | 1/2009 | Dolson et al. | |
| 2014/0133168 | A1 | 5/2014 | Fiederling et al. | |
| 2014/0175978 | A1* | 6/2014 | Kobayashi | B60Q 1/1423 315/82 |
| 2017/0089536 | A1* | 3/2017 | Courcier | F21S 48/12 |
| 2017/0241606 | A1* | 8/2017 | Courcier | F21S 48/125 |

OTHER PUBLICATIONS

International Search Report for PCT/AT2016/060050, dated Dec. 8, 2016 (2 pages).

* cited by examiner

LIGHT SOURCE ARRANGEMENT IN A PIXEL-LIGHT LIGHT MODULE

The invention relates to a lighting device for a headlight, in particular a motor-vehicle headlight, comprising a plurality of light sources, which are arranged adjacent to each other in rows and which form a lighting field, and comprising a light-guiding device having a plurality of light-guiding elements, wherein each light-guiding element is associated with one light source, wherein each light-guiding element has a light incoupling surface for coupling in light emitted by the particular light source and a light outlet surface, wherein the light-guiding elements are arranged in at least two linear rows arranged one over the other, and wherein the light-guiding elements of the lowest row are designed as high-beam light-guiding elements and form a high-beam row.

Lighting units of this kind, which are also referred to as pixel-light modules, are common in vehicle construction and are used for example for the projection of glare-free high-beam light by emission of the light from, generally, a plurality of artificial light sources and bundling of said light by a corresponding plurality of adjacently arranged light guides (add-on optics/primary optics) in the direction of emission. The light guides have a relatively small cross-section and therefore emit the light of the individual light sources associated therewith in a very concentrated manner in the direction of emission. Pixel-light headlights are very versatile in respect of the light distribution, since the illumination level can be individually controlled for each pixel, i.e. for each light guide, and any desired light distributions can be provided.

On the one hand, the concentrated emission of the light guides is desirable, for example in order to satisfy legal provisions in respect of the light-dark line of a motor-vehicle headlight or in order to provide adaptive versatile masking scenarios, but on the other hand bothersome inhomogeneities are created as a result in regions of the light image in which a uniform, concentrated and directed illumination is desired.

Document DE 10 2008 044 968 A1 discloses a lighting device having a plurality of light sources which are arranged on a light surface and which form a light-emitting diode field consisting of a plurality of rows of light-emitting diodes arranged linearly next to each other, wherein a dual spacing of adjacent light sources in at least one edge region of the light surface is larger than in a central region of the light surface. The object of document DE 10 2008 044 968 A1 is to reduce the overall number of required light sources and therefore also the production costs.

Document DE 10 2009 020 619 A1 discloses a lighting device having a plurality of light-emitting diodes which form a light-emitting diode field formed of at least two lines of light-emitting diodes arranged linearly next to each other, wherein a first line comprises light-emitting diodes that emit a stronger light than at least one second line.

Document DE 10 2012 108 309 A1 describes a headlight for vehicles that has a plurality of groups of LED light sources and a plurality of optical units having different projection characteristics.

In currently known pixel-light modules, a 2-dimensional arrangement in rows of the light sources, for example light-emitting diodes (LEDs) is used in order to generate a segmented dipped-beam and main-beam distribution. In the case of LEDs, the illumination level is controlled for example as standard by pulse width modulation of the operating current, by means of which a different energisation of the light source, as averaged over time, can be achieved. Here, the LEDs are usually energised to a greater extent in the central region than at the edge, and therefore the maximum of the light distribution lies in the middle. However, the lower energisation in the edge region can mean that inhomogeneities occur between the rows of the light distribution, typically in the form of dark stripes in the edge regions. The inhomogeneities between the high-beam row and the asymmetry row are usually particularly pronounced.

The object of the present invention is therefore to reduce the occurrence of the above-described inhomogeneities in the edge regions of the light image of pixel-light modules.

This object is achieved with a lighting device of the kind described in the introduction in that, in accordance with the invention, the vertical distance between the light sources of the high-beam row and the light sources of the row arranged adjacent in the upward direction is smaller in at least one lateral edge region of the lighting field than in a central region of the lighting field.

Thanks to the invention, which is based on a selective positioning of the light sources in the edge regions of the lighting field, the described inhomogeneities in the edge regions can be reduced. The invention therefore constitutes a technically simple and economical measure for locally influencing the light distribution in pixel-light lighting devices and thus providing a more homogeneous light distribution in the edge regions of the lighting field.

In accordance with the invention, the light sources of the high-beam row, which project the outer regions (edge regions) of the light distribution, are thus shifted slightly in the direction of the upwardly adjacent row. The light sources in the centre of the light distribution maintain a greater distance from one another, since a greater height of the main-beam distribution can thus be achieved. This shift can be different running from the central region (no shift) outwardly into the respective edge regions (greatest shift).

The terms "top" and "bottom" and "above" and "below" as used herein with reference to the arrangement of the rows of light-guiding elements and light sources relate to the arrangement of the rows in the assembled state of the pixel-light module in a headlight. Here, the high-beam row in the assembled state is always the lowest row; that is to say with downstream imaging optics the high-beam row forms the lowest light distribution in the light image.

In a development of the invention it is provided that the vertical distance between the light sources of the high-beam row and the light sources of the upwardly adjacent row decreases successively, i.e. step by step, starting from the central region to at least one of the edge regions, wherein in each step one or more light sources of the high-beam row is/are shifted more in the direction of the adjacent row arranged thereabove. The distance between the light sources of the high-beam row and the row thereabove becomes smaller in the direction of the edge region.

In a variant, the vertical distance between the light sources of the high-beam row and the light sources of the upwardly adjacent row is smaller only in a lateral edge region of the lighting field than in a central region of the lighting field.

In another variant, the vertical distance between the light sources of the high-beam row and the light sources of the upwardly adjacent row in both lateral edge regions of the lighting field is smaller than in the central region of the lighting field. In a development of this variant the vertical distance between the light sources of the high-beam row and the light sources of the upwardly adjacent row decreases successively from the central region in the direction of at least one of the edge regions.

The light incoupling surfaces of the light-guiding elements are in principle larger than the surfaces of the respective light sources (for example chip surface of the LEDs). In accordance with the prior art, the light sources are in principle positioned such that they couple in the light in the centre of the light incoupling surface of the particular light-guiding element. With regard to the invention, it is therefore advantageous if the light sources of the high-beam row which are arranged in the central region of the lighting field are positioned such that they couple in the light in the centre of the light incoupling surface of the particular light-guiding element. All light sources of the other rows couple the light in advantageously in the centre of the light incoupling surface of the particular light-guiding element.

In a development of the invention it can be provided that the horizontal distance between adjacent light sources increases in at least one of the edge regions of the lighting field in the direction of the row edge. In a variant, it is provided that the horizontal distance between adjacent light sources increases in only one edge region in the direction of the row edge. In another variant, it is provided that the horizontal distance between adjacent light sources increases in both edge regions in the direction of the row edge.

Under consideration of the imaging optics, which is normally arranged downstream of the light-guiding device in the light propagation direction, the light sources can be arranged either symmetrically or asymmetrically with respect to an optical axis.

In developments, it can be provided for photometric reasons that the individual rows of the light sources are of different lengths. The resolution in any region can thus be adapted to the requirements of a specific masking scenario.

In accordance with experience, the construction of a lighting device for pixel-light headlights is particularly efficient if the light-guiding elements are arranged in precisely three rows arranged one above the other, which together form a high-beam distribution. In an arrangement of this kind, the upper row can be formed as a forefield row, the middle row can be formed as an asymmetry row, and the lowest row can be formed as a high-beam row.

The light-guiding elements in the rows are preferably arranged as close to one another as possible, whereby inhomogeneities in the light image can be further reduced. In a development of the invention, the light outlet surfaces of the individual light-guiding elements can therefore be part of a common light outlet surface, wherein the individual light outlet surfaces border on one another. The common light outlet surface is typically a curved surface, which usually follows the Petzval surface of the imaging optics (for example an imaging lens). However, for specific applications, deliberate deviations in the curvature can also be used in order to utilise aberrations in the edge region for light homogenisation.

The light sources are expediently light-emitting diodes (LEDs), which preferably can be controlled individually. For example, the LEDs in this case are Oslon Compact LEDs with light-emitting surfaces of 0.5×0.5 $mm^2$.

It has been found that it is most practicable when the light-guiding elements are embodied as optical waveguide elements. The basic structure of optical waveguide elements and add-on optics for pixel-light lighting devices for headlights is known per se. The optical waveguide elements are manufactured for example from plastic, glass or any other materials suitable for guiding light. The optical waveguide elements are preferably manufactured from a silicone material. The optical waveguide elements are typically embodied as solid bodies and preferably consist of a single continuous optical medium, wherein the light is guided within this medium (optimised for use of total reflection at the light-guiding surfaces). The optical waveguide elements typically have a substantially square or rectangular cross-section and usually widen in the direction of light emission, as is known per se.

In an alternative embodiment, the light-guiding elements can be formed as hollow bodies with inner delimitation surfaces, wherein the delimitation surfaces run parallel to the direction of light propagation and are reflective or mirrored.

In a development, the lighting device comprises an imaging optics (for example a projection lens or a system formed of a plurality of lenses) arranged downstream of the light-guiding device in the direction of emission. Accordingly, the imaging optics can comprise one or more optical lenses of the kind known per se.

A further subject of the invention relates to a headlight, in particular a motor-vehicle headlight, comprising a lighting device according to the invention as disclosed herein. Headlights of this kind are also referred to as pixel-light headlights.

Figure 2:
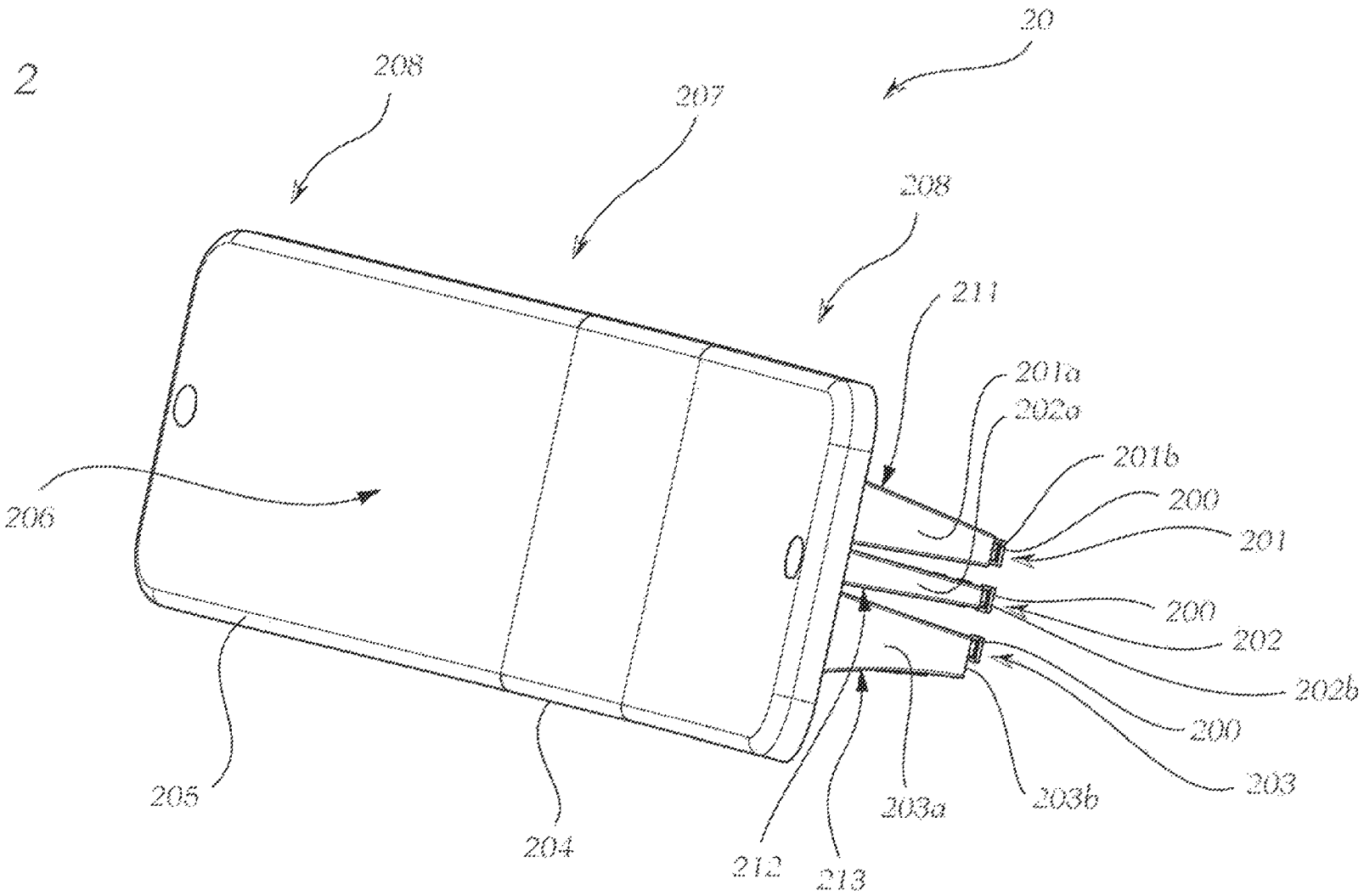
Figure 4:
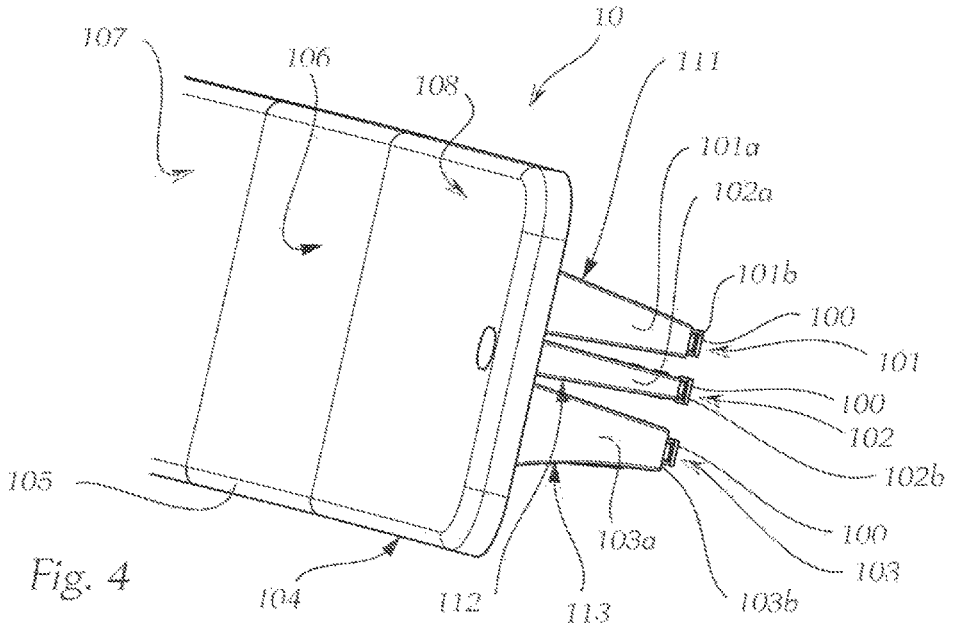
Figure 3:
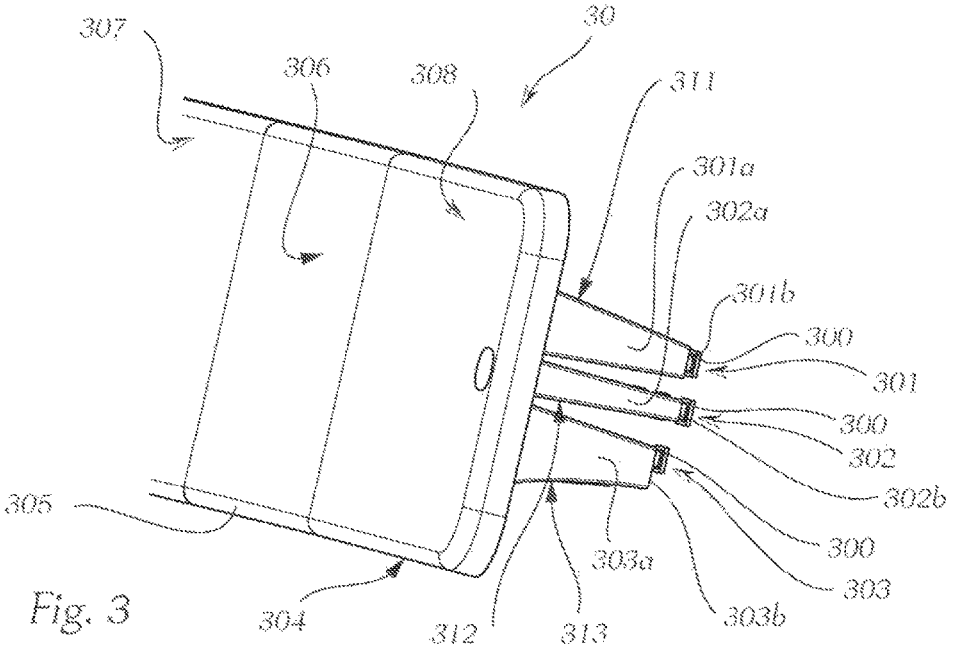

The invention and advantages thereof will be explained in greater detail hereinafter on the basis of non-limiting examples, which are shown in the accompanying drawings, in which:

FIG. 1*a* shows an arrangement of light sources (LEDs) in a pixel-light lighting device according to the prior art, FIG. 1*b* shows an arrangement of light sources (LEDs) in a pixel-light lighting device according to the invention, FIG. 1*c* shows a further arrangement of light sources (LEDs) in a pixel-light lighting device according to the invention, FIG. 2 shows a perspective view of a lighting device according to the invention with an arrangement of light sources according to FIG. 1*b*, FIG. 3 shows a perspective view of an edge region of a lighting device according to the invention with an arrangement of light sources according to FIG. 1*c*, FIG. 4 shows a perspective view of an edge region of a lighting device according to the prior art with an arrangement of light sources according to FIG. 1*a*.

FIG. 1*a* shows an arrangement of light sources 100 (LEDs 100) in a pixel-light lighting device 10 according to the prior art. The lighting device 10 is shown in FIG. 4, which shows a perspective view of the edge region thereof. The lighting device 10 comprises a plurality of LED light sources 100 and an add-on optics 104 (=primary optics) positioned in the direction of light emission. The add-on optics 104 comprises optical waveguide elements 101*a*, 102*a*, 103*a*, which are arranged in three linear rows 111, 112, 113 and which run on the emission side to a common end plate 105. The end plate 105 is delimited on the emission side by a light outlet surface 106, wherein the light outlet surfaces (not shown in greater detail) of the individual optical waveguide elements are each part of a common light outlet surface 106, wherein individual light outlet surfaces of the optical waveguide elements 101*a*, 102*a*, 103*a* border on one another in a manner known per se. The common light outlet surface 106 is typically a curved surface, which usually follows the Petzval surface of a downstream imaging optics (not shown in greater detail; for example an imaging lens). For specific applications, deliberate deviations in the curvature of the common light outlet surface 106 can also be used in order to additionally utilise aberrations in the edge region for light homogenisation. Each optical waveguide element 101*a*, 102*a*, 103*a* is assigned an LED light source 100. The light incoupling surfaces 101*b*, 102*b*, 103*b* of the optical waveguide elements 101*a*, 102*a*, 103*a* are larger than the surfaces of the respective light sources 100 (for example chip surface of the LEDs). The light sources 100 are positioned in the lighting device 10 such that they couple the light in the centre of the light incoupling surface 101*b*, 102*b*, 103*b* of the particular optical waveguide element.

In the lighting device 10, the upper row is formed as a forefield row 111 consisting of a plurality of forefield optical waveguide elements 101*a*. The middle row is formed as an asymmetry row 112 consisting of a plurality of asymmetry optical waveguide elements 102*a*, and the lower row is formed as a high-beam row 113 consisting of a plurality of high-beam optical waveguide elements 103*a*. The optical waveguide elements 101*a*, 102*a*, 103*a* are funnel-shaped, wherein the high-beam optical waveguide elements 103*a* have a larger cross-section in the direction of the light outlet surface than the optical waveguide elements of the asymmetry row 112. For this reason, the pixels of the asymmetry row 112 have a higher illuminance than those of the high-beam row 113.

It can now be seen from FIG. 1*a* that the light sources 100 of the lighting arrangement 10 are arranged in a 3*28 pixel arrangement in a total of three linear LED rows 101, 102, 103 of 28 LEDs/row and form a lighting field 109. The LEDs 100 are secured on a circuit board in a manner known per se. The light-emitting surfaces are shown in a regular arrangement. The respective vertical distances between the LEDs 100 of the individual rows 101, 102, 103 are always constant, i.e. the LEDs of a row are always arranged at the same vertical distance from the LEDs of an adjacent row. The illumination level can be controlled individually for each LED 100, and therefore any desired light distributions can be provided. With reference to FIG. 1*a* and FIG. 4, the uppermost LED row 101 couples the light into the optical waveguide elements 101*a* of the forefield row 111. The middle LED row 102 couples the light into the optical waveguide elements 102*a* of the asymmetry row 112. The lowest LED row 103 couples the light into the optical waveguide elements 103*a* of the high-beam row 113. The forefield row 111, the asymmetry row 112, and the high-beam row 113 in the activated state jointly form a high-beam distribution. Usually, the LEDs 100 in a central region 107 are in this case energised more strongly than in the edge regions 108 to the left and right of the central region 107, and therefore the maximum of the light distribution lies in the central region 107. However, the lower energisation in the edge regions 108 can mean that inhomogeneities occur between the rows of the light distribution, typically in the form of dark stripes in the edge regions 108. The inhomogeneities between the high-beam row 113 and the asymmetry row 112 are usually particularly pronounced.

FIG. 1*b* shows an arrangement of LED light sources 200 in a pixel-light lighting device 20 according to the invention (see also FIG. 2 in this respect). The lighting device 20 is shown in greater detail in FIG. 2, which shows a perspective view of a lighting device 20 according to the invention.

The lighting device 20 comprises a plurality of LED light sources 200 and a light-guiding device 204, referred to hereinafter as an add-on optics 204 (=primary optics), positioned in the direction of light emission. The add-on optics 204 is constructed identically to the add-on optics 104. The add-on optics 204 consequently comprises optical waveguide elements 201*a*, 202*a*, 203*a*, which are arranged in three linear rows 211, 22, 213 and which run on the emission side to a common end plate 205. The end plate 205 is delimited on the emission side by a light outlet surface 206, wherein the light outlet surfaces (not shown in greater detail) of the individual optical waveguide elements 201*a*, 202*a*, 203*a* are each part of the common light outlet surface 206, wherein individual light outlet surfaces of the optical waveguide elements 201*a*, 202*a*, 203*a* border on one another in a manner known per se. The common light outlet surface 206 is typically a curved surface, which usually follows the Petzval surface of a downstream imaging optics (not shown in greater detail; for example an imaging lens). For specific applications, deliberate deviations in the curvature of the common light outlet surface 206 can also be used in order to additionally utilise aberrations in the edge region for light homogenisation. Each optical waveguide element 201*a*, 202*a*, 203*a* of the add-on optics 204 is assigned an LED light source 200. The light incoupling surfaces 201*b*, 202*b*, 203*b* of the optical waveguide elements 201*a*, 202*a*, 203*a* are larger than the surfaces of the respective LED light sources 200 (for example chip surface of the LEDs).

In the lighting device 20, the upper row is formed as a forefield row 211 consisting of a plurality of forefield optical waveguide elements 201*a*. The middle row is formed as an asymmetry row 212 consisting of a plurality of asymmetry optical waveguide elements 202*a*, and the lower row is formed as a high-beam row 213 consisting of a plurality of high-beam optical waveguide elements 203*a*. The optical waveguide elements 201*a*, 202*a*, 203*a* are funnel-shaped, wherein the high-beam optical waveguide elements 203*a* have a larger cross-section in the direction of the light outlet surface than the optical waveguide elements of the asymmetry row 212. For this reason, the pixels of the asymmetry row 212 have a higher illuminance than those of the high-beam row 213.

It can be seen from FIG. 1*b* that the light sources 200 of the lighting arrangement 20 are arranged in a 3*28 pixel arrangement in a total of three LED rows 201, 202, 203 of 28 LEDs/row and form a lighting field 209. The LEDs 200 are secured on a circuit board in a manner known per se. The illumination level can be controlled individually for each LED 200, and therefore any desired light distributions can be provided. With reference to FIG. 1*b* and FIG. 2, the uppermost LED row 201 couples the light into the optical waveguide elements 201*a* of the forefield row 211. The middle LED row 202 couples the light into the optical waveguide elements 202*a* of the asymmetry row 212. The lowest LED row 203 couples the light into the optical waveguide elements 203*a* of the high-beam row 213. The forefield row 211, the asymmetry row 212, and the high-beam row 213 in the activated state jointly form a high-beam distribution. Usually, the LEDs 200 in a central region 207 are in this case energised more strongly than in the edge regions 208 to the left and right of the central region 207, and therefore the maximum of the light distribution lies in the central region 207.

The respective vertical distances between the LEDs 200 of the rows 201 and 202 (assigned to the forefield row 211 and asymmetry row 212) are always constant, i.e. the LEDs of the forefield row 211 are always arranged at the same vertical distance from the LEDs of the asymmetry row 212. The arrangement according to the invention of the LED light sources 200 differs from the arrangement according to the prior art (FIG. 1*a*) in that the vertical distance between the LED light sources 200 of the high-beam row 212 and the LED light sources 200 of the upwardly adjacent row (i.e. the asymmetry row 212) in the lateral edge regions 208 of the lighting field is smaller than in a central region 207 of the lighting field. In other words, the vertical distance between the light sources 200 of the high-beam row 213 and the light sources 200 of the asymmetry row 212 decreases starting from the central region 207 in the direction of the edge regions 208 of the lighting field 209 successively, i.e. step by step, from LED to LED. The LED light sources 200 are arranged symmetrically with respect to an optical axis. The LED light sources 200 of the LED rows 201 and 202 and the LED light sources 200 in the central region 207 of the LED row 203 are positioned such that they couple in the light in the centre of the light incoupling surface 201*b*, 202*b*, 203*b* of the particular optical waveguide element 201*a*, 202*a*, 203*a*. The LED light sources 200 in the edge regions 208 of the LED row 203 (i.e. assigned to the high-beam row 213) are shifted from the centre of the light incoupling surface 203*b* of the particular optical waveguide element 203*a* upwardly in the direction of the LED row 202 (i.e. assigned to the asymmetry row 212) (see also FIG. 2, in which this shift is clearly visible). By means of the selective arrangement according to the invention of the LED light sources 200 in the edge regions 208 of the lighting field 209, the inhomogeneities in the light image, as are known from the prior art, can be reduced. The arrangement according to the invention therefore constitutes a technically simple and economical measure for locally influencing the light distribution in pixel-light lighting devices and thus providing a more homogeneous light distribution in the edge regions 208 of the lighting field 209.

FIG. 1*c* shows a further variant of an arrangement of light sources (LEDs) 300 in a pixel-light lighting device 30 according to the invention. The lighting device 30 is shown in FIG. 3, which shows a perspective view of the edge region thereof.

The lighting device 30 comprises a plurality of LED light sources 300 and a light-guiding device 304, referred to hereinafter as an add-on optics 304 (=primary optics), positioned in the direction of light emission. The add-on optics 304 comprises optical waveguide elements 301*a*, 302*a*, 303*a*, which are arranged in three linear rows 311, 312, 313 and which run on the emission side to a common end plate 305. The end plate 305 is delimited on the emission side by a light outlet surface 306, wherein the light outlet surfaces (not shown in greater detail) of the individual optical waveguide elements 301*a*, 302*a*, 303*a* are each part of the common light outlet surface 306, wherein individual light outlet surfaces of the optical waveguide elements 301*a*, 302*a*, 303*a* border on one another in a manner known per se. The common light outlet surface 306 is typically a curved surface, which usually follows the Petzval surface of a downstream imaging optics (not shown in greater detail; for example an imaging lens). For specific applications, deliberate deviations in the curvature of the common light outlet surface 306 can also be used in order to additionally utilise aberrations in the edge region for light homogenisation. Each optical waveguide element 301*a*, 302*a*, 303*a* of the add-on optics 304 is assigned an LED light source 300. The light incoupling surfaces 301*b*, 302*b*, 303*b* of the optical waveguide elements 301*a*, 302*a*, 303*a* are larger than the surfaces of the respective LED light sources 300 (for example chip surface of the LEDs).

In the lighting device 30, the upper row is formed as a forefield row 311 consisting of a plurality of forefield optical waveguide elements 301*a*. The middle row is formed as an asymmetry row 312 consisting of a plurality of asymmetry optical waveguide elements 302*a*, and the lower row is formed as a high-beam row 313 consisting of a plurality of high-beam optical waveguide elements 303*a*. The optical waveguide elements 301*a*, 302*a*, 303*a* are funnel-shaped, wherein the high-beam optical waveguide elements 303*a* have a larger cross-section in the direction of the light outlet surface than the optical waveguide elements of the asymmetry row 312. For this reason, the pixels of the asymmetry row 312 have a higher illuminance than those of the high-beam row 313.

The LED light sources 300 are arranged in a pixel arrangement in a total of three LED rows 301, 302, 303 of 25, 30, and 28 LEDs and form a lighting field 309 (see FIG. 1*c*). The LEDs 300 are secured to a circuit board (not shown) in a manner known per se. The illumination level can be controlled individually for each LED 300, and therefore any desired light distributions can be provided.

Similarly to the variant according to the invention shown in FIG. 1*b* and FIG. 2, the uppermost LED row 301 couples the light into the optical waveguide elements 301*a* of the forefield row 311 of the add-on optics 304. The middle LED row 302 couples the light into the optical waveguide elements 302*a* of the asymmetry row 312 of the add-on optics 304. The lowest LED row 303 couples the light into the optical waveguide elements 303*a* of the high-beam row 313 of the add-on optics 304. The forefield row 311, the asymmetry row 312, and the high-beam row 313 jointly form a high-beam distribution in the activated state. Here, the LEDs 300 are energised more heavily in a central region 307 than in the edge regions 308 to the left and right of the central region 307, and therefore the maximum of the light distribution lies in the central region 307.

The vertical distance between the LEDs 300 of the rows 301 and 302 (forefield row and asymmetry row) is always constant (FIG. 1*c*), i.e. the LEDs 300 of the forefield row are always arranged at the same vertical distance from the LEDs of the asymmetry row. The arrangement according to the invention of the LED light sources 300 from FIG. 1*c* thus differs from the arrangement according to the prior art (FIG. 1*a*) in that the vertical distance between the LED light sources 300 of the row 303 (assigned to the high-beam row 313) and the LED light sources 300 of the upwardly adjacent LED row 302 (assigned to the asymmetry row 312) in the lateral edge regions 308 of the lighting field 309 is smaller than in a central region 307 of the lighting field 309. In other words, the vertical distance between the light sources 300 of the high-beam row and the light sources 300 of the asymmetry row decreases starting from the central region 307 in the direction of the edge regions 308 of the lighting field 309 successively. In a development of the arrangement according to the invention shown in FIG. 1*b*, the horizontal distance between adjacent LED light sources 300 in the edge regions 308 of all three LED rows 301, 302, 303 increases in this embodiment in the direction of the row edge. The individual rows 301, 302 and 303 additionally have different lengths. The LED light sources 300 are arranged asymmetrically with respect to an optical axis 310. In the installed state in a headlight module, the circuit board to which the LED light sources 300 are secured is normally a common part. The circuit board is constructed identically in the left and right motor-vehicle headlight. The add-on optics 30 is provided in mirror-symmetrical variants. An imaging optics provided in the direction of light emission is then again a common part, but is arranged shifted mirror-symmetrically, for example with the aid of a lens holder.

The difference in the construction of the add-on optics 30 compared to the above-described add-on optics 10 and 20 lies in the fact that the optical waveguide elements 301*a*, 302*a*, 303*a* are likewise horizontally shifted accordingly on account of the additional horizontal shifting of the LEDs 300 in the edge regions 308 (see FIG. 3). The LED light sources 300 of the LED rows 301 and 302 and the LED light sources 300 in the central region 307 of the LED row 303 are consequently positioned such that they couple in the light in the centre of the light incoupling surface 301*b*, 302*b*, 303*b* of the particular optical waveguide element 301*a*, 302*a*, 303*a*. The LED light sources 300 in the edge regions 308 of the LED row 303 (i.e. assigned to the high-beam row 313) are shifted in accordance with the invention from the centre of the light incoupling surface 303*b* of the particular optical waveguide element 303*a* upwardly in the direction of the adjacent LEDs 300 of the asymmetry row 312.

The optical waveguide elements 201*a*, 202*a*, 203*a* and 301*a*, 302*a*, 303*a* shown in FIGS. 2 and 3 respectively can be manufactured for example from silicone, plastic, glass or any other materials suitable for guiding light. The optical waveguide elements 201*a*, 202*a*, 203*a* and 301*a*, 302*a*, 303*a* are embodied as solid bodies and consist of a single continuous optical medium, wherein the light is guided within this medium.

The LEDs 200 and 300 (FIG. 1*b*, FIG. 1*c*) can be, for example, Oslon Compact LEDs with light-emitting surfaces of 0.5×0.5 $mm^2$. The total arrangement is approximately 10 cm wide.

The invention can be modified in any way known to a person skilled in the art and is not limited to the presented embodiment. Individual aspects of the invention can also be taken and combined widely with one another. What are essential are the ideas forming the basis of the invention, which can be realised in a variety of ways by a person skilled in the art in view of this teaching but are not modified in essence.

The invention claimed is:

1. A lighting device (20, 30) for a motor-vehicle headlight, comprising:

a plurality of light sources (200, 300), which are arranged adjacent to each other in rows (201, 202, 203, 301, 302, 303) and which form a lighting field (209, 309)

a light-guiding device (204, 304) having a plurality of light-guiding elements (201*a*, 202*a*, 203*a*, 301*a*, 302*a*, 303*a*), wherein each light-guiding element (201*a*, 202*a*, 203*a*, 301*a*, 302*a*, 303*a*) is associated with one of the light sources (200, 300), wherein each light-guiding element (201*a*, 202*a*, 203*a*, 301*a*, 302*a*, 303*a*) has a light incoupling surface (201*b*, 202*b*, 203*b*, 301*b*, 302*b*, 303*b*) for coupling in light emitted by the particular light source and a light outlet surface, wherein the light-guiding elements (201*a*, 202*a*, 203*a*, 301*a*, 302*a*, 303*a*) are arranged in at least two linear rows (211, 212, 213, 311, 312, 313) arranged one over the other, and wherein the light-guiding elements (203*a*, 303*a*) of the lowest row (213, 313) are designed as high-beam light-guiding elements (201*a*, 301*a*) and form a high-beam row (213, 313), wherein the vertical distance between the light sources (200, 300) of the high-beam row (213, 313) and the light sources (200, 300) of the row (212, 312) arranged adjacent in the upward direction is smaller in at least one lateral edge region (208, 308) of the lighting field (209, 309) than in a central region (207, 307) of the lighting field (209, 309).

2. The lighting device according to claim 1, wherein the vertical distance between the light sources (200, 300) of the high-beam row (213, 313) and the light sources (200, 300) of the upwardly adjacent row (212, 312) decreases successively starting from the central region (207, 307) in the direction of at least one of the edge regions (208, 308).

3. The lighting device according to claim 1, wherein the vertical distance between the light sources (200, 300) of the high-beam row (213, 313) and the light sources (200, 300) of the upwardly adjacent row (212, 312) in both lateral edge regions (208, 308) of the lighting field (209, 309) is smaller than in the central region (207, 307) of the lighting field (209, 309).

4. The lighting device according to claim 3, wherein the vertical distance between the light sources (200, 300) of the high-beam row (213, 313) and the light sources of the upwardly adjacent row (212, 312) decreases successively starting from the central region (207, 307) in the direction of both edge regions (208, 308).

5. The lighting device according to claim 1, wherein the light sources (200, 300) of the high-beam row (213, 313) which are arranged in the central region (207, 307) of the lighting field (209, 309) are positioned such that they couple in the light in the centre of the light incoupling surface (201*b*, 301*b*) of the particular light-guiding element (201*a*, 301*a*).

6. The lighting device according to claim 1, wherein the horizontal distance between adjacent light sources (300) increases in at least one of the edge regions (308) of the lighting field (309) in the direction of the row edge.

7. The lighting device according to claim 6, wherein the horizontal distance between adjacent light sources (300) in both edge regions (308) increases in the direction of the row edge.

8. The lighting device according to claim 1, wherein the light sources (200) are arranged symmetrically with respect to an optical axis (210).

9. The lighting device according to claim 1, wherein the light sources (300) are arranged asymmetrically with respect to an optical axis (310).

10. The lighting device according to claim 1, wherein the individual rows (301, 302, 303) of light sources (300) have different lengths.

11. The lighting device according to claim 1, wherein the light-guiding elements (201*a*, 202*a*, 203*a*, 301*a*, 302*a*, 303*a*) are arranged in precisely three rows (211, 212, 213, 311, 312, 313) one above the other and jointly form a high-beam distribution, wherein the lowest row is the high-beam row (213, 313).

12. The lighting device according to claim 1, wherein the light outlet surfaces of the light-guiding elements (201*a*, 202*a*, 203*a*, 301*a*, 302*a*, 303*a*) are part of a common light outlet surface (206, 306), wherein individual light outlet surfaces border on one another.

13. The lighting device according to claim 1, wherein the light sources (200, 300) are light-emitting diodes (LEDs), which can be controlled individually.

14. The lighting device according to claim 1, wherein the light-guiding elements (201*a*, 202*a*, 203*a*, 301*a*, 302*a*, 303*a*) are embodied as optical waveguide elements.

15. The lighting device according to claim 1, further comprising an imaging optics arranged downstream of the light-guiding device (204, 304).

16. The lighting device according to claim 15, wherein the imaging optics comprises one or more optical lenses.

17. A motor-vehicle headlight comprising the lighting device (20, 30) according to claim 1.

* * * * *